US011383141B1

(12) United States Patent
Swift

(10) Patent No.: US 11,383,141 B1
(45) Date of Patent: Jul. 12, 2022

(54) SKATEBOARD BAND

(71) Applicant: Tim Swift, San Clemente, CA (US)

(72) Inventor: Tim Swift, San Clemente, CA (US)

( * ) Notice: Subject to any disclaimer, the term of this patent is extended or adjusted under 35 U.S.C. 154(b) by 0 days.

(21) Appl. No.: 17/695,035

(22) Filed: Mar. 15, 2022

Related U.S. Application Data

(60) Provisional application No. 63/208,697, filed on Jun. 9, 2021, provisional application No. 63/161,885, filed on Mar. 16, 2021.

(51) Int. Cl.
*A63C 17/01* (2006.01)
*A63B 69/00* (2006.01)
*A63C 17/00* (2006.01)

(52) U.S. Cl.
CPC ..... *A63B 69/0093* (2013.01); *A63C 17/012* (2013.01); *A63C 17/0006* (2013.01)

(58) Field of Classification Search
CPC ..... A63C 17/012; A63C 17/0006; A63B 69/0093
See application file for complete search history.

(56) References Cited

U.S. PATENT DOCUMENTS 4,887,825 A * 12/1989 Allen ..... A63C 17/265 441/75
5,020,827 A * 6/1991 Murdoch ..... A63C 17/265 441/75
5,167,553 A * 12/1992 Wilson ..... B63B 32/77 441/75
6,199,881 B1 * 3/2001 Wood ..... A63C 17/262 441/74
6,488,294 B2 * 12/2002 Lumb ..... A63C 17/262 280/87.042
6,536,639 B1 * 3/2003 Frank ..... A45F 3/14 224/264
6,935,645 B1 * 8/2005 Fuhrmeister ..... A63C 17/265 280/809
9,248,359 B2 * 2/2016 Marroquin ..... A63C 17/265
2010/0007161 A1 * 1/2010 Sears ..... A63C 17/00 294/147
2010/0102098 A1 * 4/2010 Stewart ..... A63C 17/00 224/257
2010/0276912 A1 * 11/2010 Lange ..... A63C 17/26 280/727
2011/0291375 A1 * 12/2011 Lawson ..... A63C 17/265 434/247
2016/0360867 A1 * 12/2016 Schumacher ..... A45F 3/14

* cited by examiner

*Primary Examiner* — Erez Gurari
(74) *Attorney, Agent, or Firm* — Guy Cumberbatch

(57) ABSTRACT

An elastic band for a skateboard. The band is an elastomer such as EPDM and stretches over the deck of the skateboard longitudinally with a central span under which the rider's feet can be inserted. The band has opposed ends with loops that may be wrapped around the skateboard trucks under the deck. The band is stretched taut, but has sufficient flexibility to enable the rider's feet to be inserted under the central span. Equipping a board with the band enables a rider to perform various tricks that ordinarily require the hands, and the feel is similar to a snowboard, which provides a way to practice snowboarding on the street.

20 Claims, 3 Drawing Sheets

SKATEBOARD BAND

RELATED APPLICATION INFORMATION

This application claims the benefit of U.S. Provisional Application Nos. 63/208,697, filed Jun. 9, 2021, and 63/161,885, filed Mar. 16, 2021, the contents of which are incorporated herein by reference.

BACKGROUND

Field

This disclosure relates to a skateboard band and, more particularly, to a band that may be secured to a skateboard for help in doing tricks with the board.

Description of the Related Art

Skateboards have been around since the 1960's, though modern skateboards were developed starting in the late 1970s. Skateboarding has remained consistently popular, even showing up in professional sports such as the X-Games and European Skateboarding Championships. Interest from more and more people has led to advances in skateboard styles and teaching.

Despite great interest, skateboard training techniques have remained essentially the same for decades. Consequently, there is a need for a device which helps experts master various difficult tricks and new moves.

SUMMARY OF THE INVENTION

A skateboard band or strap that helps skaters learn to perform hard tricks on a skateboard is disclosed. The band is elastic and stretches over the deck of the skateboard longitudinally with a central span under which the rider's feet can be inserted. The band is a contiguous, homogenous elastic band with opposed ends having loops that may be wrapped around the skateboard trucks and wheels under the deck. The band is stretched taut, but has sufficient flexibility to enable the rider's feet to be inserted under the central span.

The present application provides a skateboard band, comprising an elastic band having a thickness and defining a central span with a longitudinal length and a constant lateral width, the band having opposed longitudinal ends of the central span shaped with loops. The loops may be circular, and may be wider in lateral dimension than the lateral width of the central span.

A method for assisting skateboarders to master hard tricks, comprising providing an elastic band defining a central span having opposed longitudinal ends shaped with loops, stretching the band longitudinally over the top of a skateboard deck and stretching the opposed longitudinal ends around the opposite deck ends, wrapping the loop-shaped ends around each of the two trucks and wheels under the deck, and inserting a rider's two feet under the central span on top of the deck and skating.

Other features and characteristics of the present invention, as well as the methods of operation, functions of related elements of structure and the combination of parts, and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION

Unless defined otherwise, all terms of art, notations and other technical terms or terminology used herein have the same meaning as is commonly understood by one of ordinary skill in the art to which this disclosure belongs. All patents, applications, published applications and other publications referred to herein are incorporated by reference in their entirety. If a definition set forth in this section is contrary to or otherwise inconsistent with a definition set forth in the patents, applications, published applications, and other publications that are herein incorporated by reference, the definition set forth in this section prevails over the definition that is incorporated herein by reference.

Unless otherwise indicated or the context suggests otherwise, as used herein, "a" or "an" means "at least one" or "one or more."

Furthermore, unless otherwise stated, any specific dimensions mentioned in this description are merely representative of an exemplary implementation of a device embodying aspects of the invention and are not intended to be limiting.

Figure 1A:
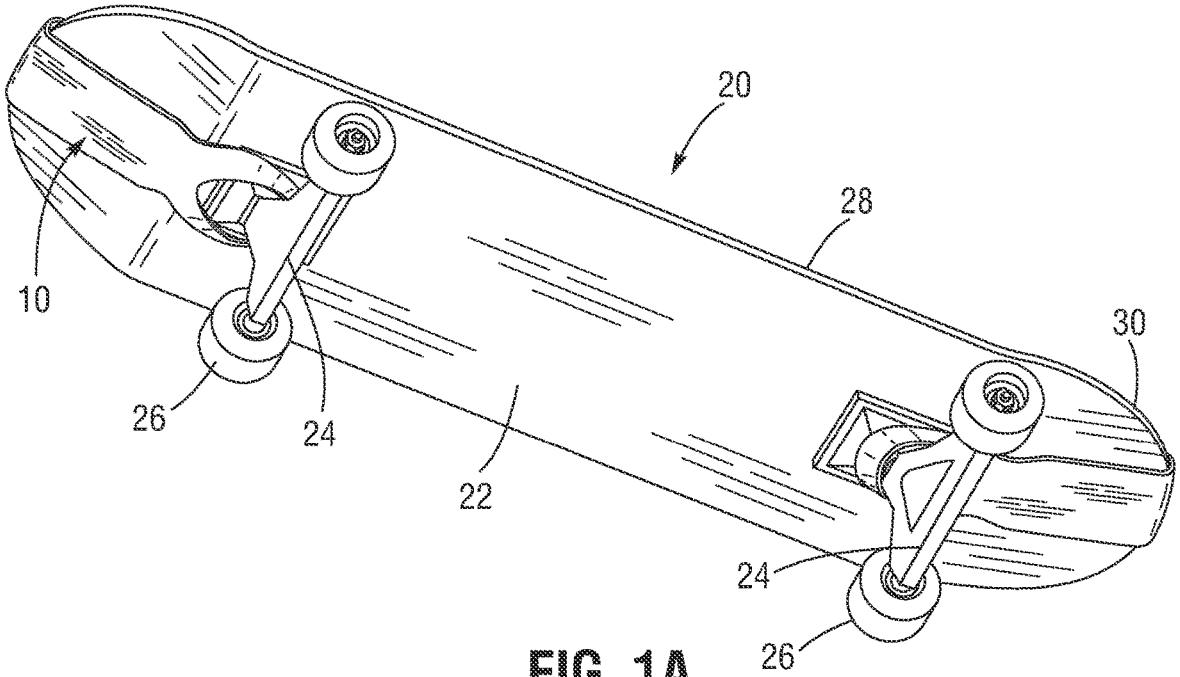
FIG. 1A is a perspective view of a skateboard and band of the present application from below.
Figure 1B:
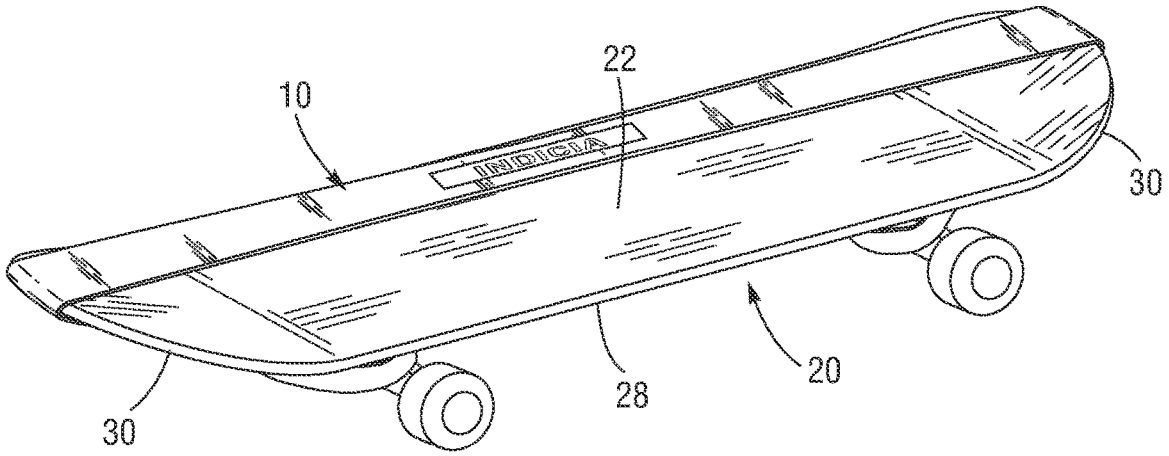
FIG. 1B is a perspective view of the skateboard and band from above.

FIGS. 1A and 1B are perspective views from below and above of a band 10 of the present application mounted on a skateboard 20. The skateboard 20 includes a deck 22 with a pair of trucks 24 mounted on the underside that support a plurality of wheels 26. As with conventional skateboards, there are preferably four wheels 26 and two trucks 24 as shown, though more wheels per truck may also be utilized.

A standard deck 22 has a length of at least 2 feet in length, such as between about 24-33 inches, and a width W of between about 6-10 inches, though smaller and larger boards are available. The deck 22 has generally straight side edges 28 terminating in rounded ends 30 which are angled upwards from a planar middle of the deck by an inch or more.

The band 10 is stretched longitudinally over the top of the skateboard deck 22 such that opposed longitudinal ends 12 stretch around the opposite deck ends 30. The longitudinal ends 12 are loop-shaped and wrap around each of the two trucks 24 under the deck, specifically around the wheels 26 so as to catch on the posts of the trucks 24 just under the deck 22. The band 10 thus is elevated over the deck 22 by the height of the deck ends 30.

Figure 2A:
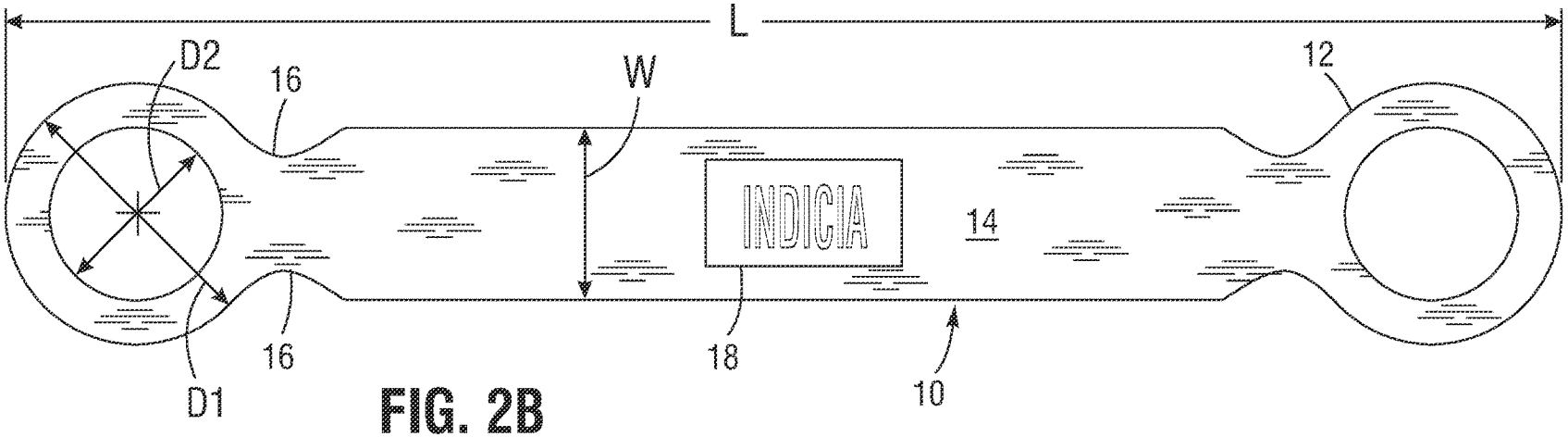
FIG. 2A is a top plan view of the skateboard band in a relaxed state.
Figure 2B:
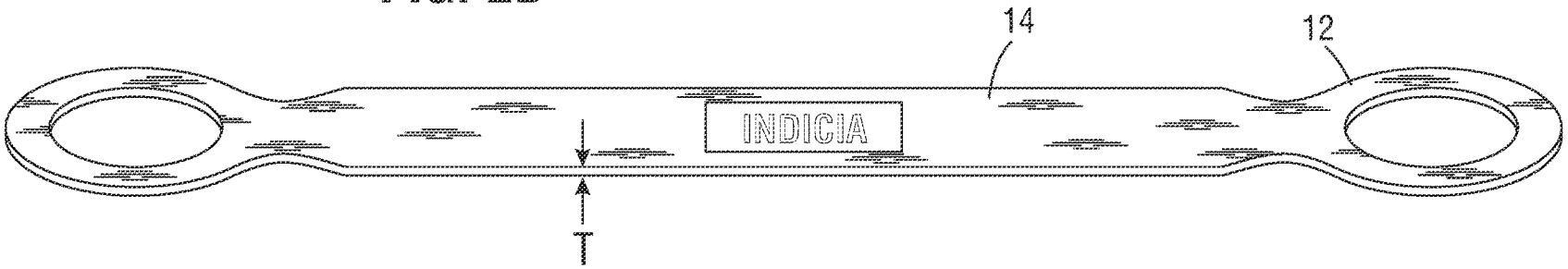
FIG. 2B is a perspective view from the side.

FIG. 2A is a top plan view of the skateboard band 10 in a relaxed state, and FIG. 2B is a perspective view from the side. The band 10 is a contiguous, homogenous elastic band, meaning the band is formed of a single piece of elastomer of uniform physical properties. When unstretched or relaxed, the band 10 has a total length L, a width W of a central span 14, and the loop-shaped longitudinal ends 12 are desirably circular. The longitudinal ends 12 have an outer diameter D1 and an inner diameter D2 of the hole in the loop. The band 10 also has a constant thickness T. Preferably, the central span 14 has a constant lateral width with lateral rounded indents 16 provided between the loop-shaped longitudinal ends 12 and the central span.

The outer diameter D1 of the longitudinal ends 12 is preferably larger than the width W of the central span 14. For instance, the outer diameter D1 is between about 4-6 inches, while the width W is between about 3-5 inches. A preferred band 10 has a width W of 4 inches, an outer diameter D1 of the ends of 6 inches, and an inner diameter D2 of the ends of 4 inches. Further, the material is desirably about 3/16 inches (3/16±1/8 inches or 4.76±3.18 mm) elastic material: neoprene, EPDM (ethylene propylene diene monomer), gum rubber, neoprene, latex, silicone, or another suitable elastomer.

The total length L of the band 10 partly depends on the length of the skateboard on which the band 10 is mounted, though a typical length is between about 42±6 inches. A 42-inch band 40 is sized to be stretched taut around a skateboard of between 27-32 inches. The total length L of the band 10 is preferably about 10-20% longer than the length of the skateboard so that it may be easily stretched around the opposite deck ends 30 and wrapped around the trucks 24.

With the band 10 mounted on a skateboard 20, riders have a tool to have fun and expand their ability to do tricks that they cannot do on a normal skateboard—things like no hand backflips or 360*s* will be possible with the band. Skating opportunities on a ramp expand as well so that, for instance, one can do "grab" tricks without grabbing. The feeling you get on a skateboard with the band is similar to riding a snowboard, and will allow riders to cross train for snowboarding in the summer months. The band is not intended to replace high level ollie moves, but is just intended for fun and to expand the things riders can do on a skateboard. Riding with the band on is actually harder to do than just riding a skateboard alone. It is recommended that the proper safety equipment such as pads and helmet are used, just like one would use riding a skateboard without the band.

Figure 3:
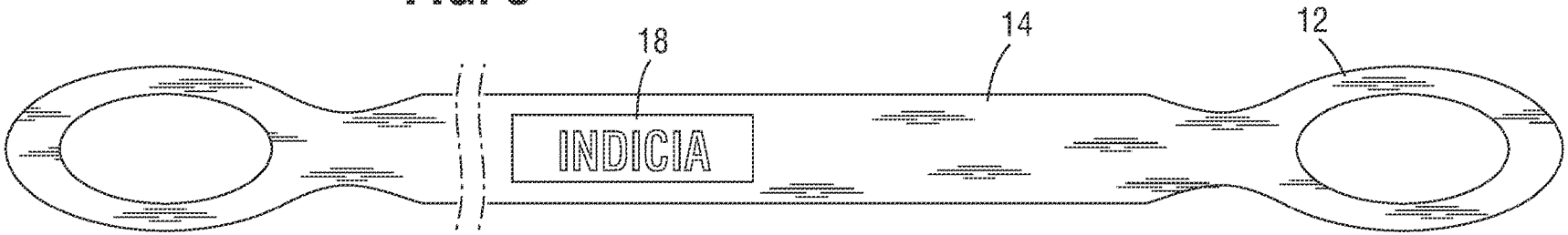
FIG. 3 is a top plan view of the skateboard band in a stretched state.

FIG. 3 is a top plan view of the skateboard band in a stretched state, which shows the central span 14 stretched and thus narrowed. In one embodiment, a label, logo or other indicia 18 is printed on one or both sides of the central span 14 which may be read in both the relaxed and stretched states. For instance, the characters or images of the indicia 18 is compressed longitudinally when relaxed, but stretches and separates when the band is stretched as in FIG. 3. If the indicia comprises numeric and/or alphabetic characters it assumes normal font proportions when stretched. Instructions, advertising or illustrations may make up the indicia 18.

Figure 4A:
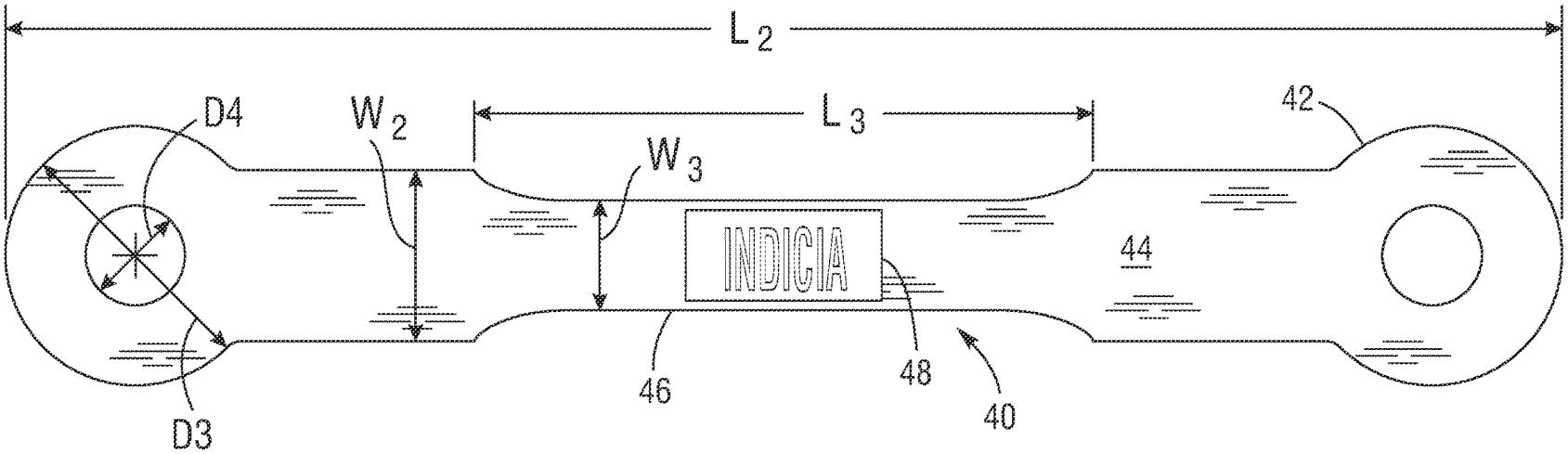
FIG. 4A is a top plan view of an alternative skateboard band in a relaxed state.
Figure 4B:
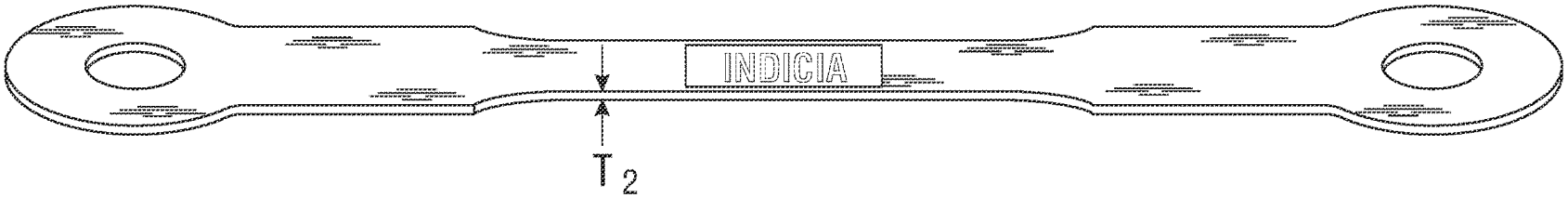
FIG. 4B is a perspective view from the side.

FIG. 4A is a top plan view of an alternative skateboard band 40 in a relaxed state, and FIG. 4B is a perspective view from the side. Again, the band 40 is a contiguous, homogenous elastic band—i.e., formed of a single piece of elastomer of uniform physical properties. When unstretched or relaxed, the band 40 has a total length $L_2$, a major width $W_2$ of a middle span 44, and loop-shaped longitudinal ends 42 which are desirably circular. The longitudinal ends 42 have an outer diameter D3 and an inner diameter D4 of the hole in the loop. The band 40 also has a constant thickness $T_2$. Preferably, a central laterally-indented region 46 is provided between the longitudinal ends 42 and at the middle of the central span 44 having a minor width $W_3$ and minor length $L_3$.

The outer diameter D3 of the longitudinal ends 42 is preferably larger than the major width $W_2$ of the central span 44. For instance, the outer diameter D3 is about 6±2 inches, while the width $W_2$ is about 4±1 inches. The inner diameter D4 of the hole in the loop may be 3±2 inches. A preferred band 40 has a width $W_2$ of 4 inches, an outer diameter D3 of the ends of 6 inches, and an inner diameter D4 of the ends of 2.5 inches. The minor width $W_3$ may be about 3±1 inches, and the central indented region 46 spans a minor length $L_3$ between 25-40% of the total length $L_2$.

Further, the material thickness $T_2$ is desirably 3/16 inches (3/16±1/8 inches or 4.76±3.18 mm) elastic material: neoprene, EPDM (ethylene propylene diene monomer), gum rubber, neoprene, latex, silicone, or another suitable elastomer. An effective material is EPDM rubber with high elasticity approximately Shore A of 40. It is die cut from a sheet of elastomer and the logo (item 48) is screen printed on the rubber. The band is tight enough to hold to the skateboard and also allow for a firm attachment by the rider.

The total length $L_2$ of the band 40 partly depends on the length of the skateboard on which the band 40 is mounted, though a typical length is about 42±6 inches. A 42-inch band 40 is sized to be stretched taut around a skateboard of between 27-32 inches. The central indented region 46 spans between 25-40% of the total length $L_2$. For a 42-inch band 40 the central indented region 46 spans about 17±7 inches. The total length $L_2$ of the band 40 is preferably about 10-20% longer than the length of the skateboard so that it may be easily stretched around the opposite deck ends 30 and wrapped around the trucks 24.

Figure 5:
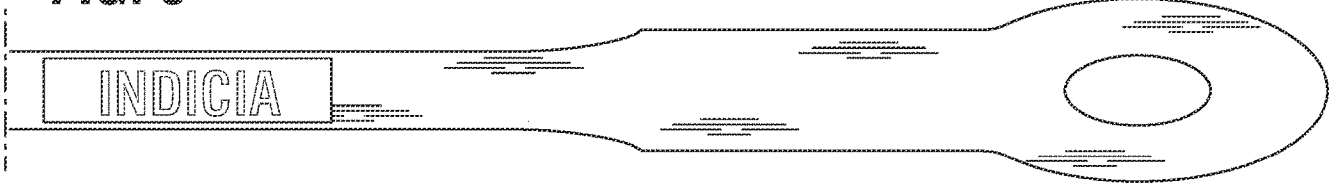
FIG. 5 is a top plan view of a portion of the alternative skateboard band in a stretched state.

FIG. 5 is a top plan view of a portion of the alternative skateboard band in a stretched state, which shows the central span 44 stretched and thus narrowed. In one embodiment, a label, logo or other indicia 48 is printed on one or both sides of the central span 44 which may be read in both the relaxed and stretched states. For instance, the characters or images of the indicia 48 is compressed longitudinally when relaxed, but stretches and separates when the band is stretched as in FIG. 5. If the indicia 48 comprises numeric and/or alphabetic characters it assumes normal font proportions when stretched. Instructions, advertising or illustrations may make up the indicia 48.

CLOSING COMMENTS

Throughout this description, the embodiments and examples shown should be considered as exemplars, rather than limitations on the apparatus and procedures disclosed or claimed. Although many of the examples presented herein involve specific combinations of elements, it should be understood that those elements may be combined in other ways to accomplish the same objectives. Elements and features discussed only in connection with one embodiment are not intended to be excluded from a similar role in other embodiments.

It is claimed:

1. An elastic band for a skateboard, the skateboard having a deck with a length between longitudinal ends of between 27-32 inches and having two pairs of trucks and wheels mounted under the deck, comprising:

a contiguous, homogenous elastic band having a constant thickness and defining a central span with a longitudinal length and a lateral width, the band having opposed longitudinal ends of the central span shaped with loops, wherein a total length $L_2$ of the band is between 10-20% greater than the skateboard length, the band being configured to stretch around the longitudinal ends of the decks with each loop encircling a pair of trucks and wheels.

2. The elastic band of claim 1, wherein the loops are circular.

3. The elastic band of claim 1, wherein the loops are wider in lateral dimension than a maximum lateral width $W_2$ of the central span.

4. The elastic band of claim 3, wherein an outer diameter D3 of the loops is about 6±2 inches, while the maximum lateral width $W_2$ is about 4±1 inches.

5. The elastic band of claim 1, wherein the total length $L_2$ includes the longitudinal length of the central span plus a combined longitudinal length of the loops, and wherein the central span has a maximum lateral width $W_2$ that is smaller in width than the loops.

6. The elastic band of claim 5, wherein the central span has a central laterally-indented region at a middle of the central span with a minor width $W_3$ and minor length $L_3$.

7. The elastic band of claim 6, wherein the band has a maximum lateral width $W_2$ of about 4 inches, and the minor width $W_3$ is about 3 inches.

8. The elastic band of claim 1, wherein the central span has a constant lateral width with lateral rounded indents provided between the loops on the longitudinal ends and the central span.

9. The elastic band of claim 1, wherein the thickness is about 3/16 inches.

10. The elastic band of claim 9, wherein the elastic band is made of EPDM.

11. The elastic band of claim 1, further including indicia printed on one or both sides of the central span which has characters or images that are compressed longitudinally when the band is relaxed, but which stretch and separate when the band is longitudinally stretched.

12. The elastic band of claim 11, wherein the indicia comprises numeric and/or alphabetic characters that assume normal font proportions when stretched.

13. An elastic band for a skateboard, the skateboard having a deck with a length between longitudinal ends of between 27-32 inches and having two pairs of trucks and wheels mounted under the deck, comprising:

a contiguous, homogenous elastic band having a constant thickness and defining a central span with a longitudinal length and a lateral width, the band having opposed longitudinal ends of the central span shaped with loops, wherein the central span has a maximum lateral width $W_2$ that is smaller in width than the loops, and the central span has a central laterally-indented region at a middle of the central span with a minor width $W_3$ and minor length $L_3$, wherein the band is configured to stretch around the longitudinal ends of the decks with each loop encircling a pair of trucks and wheels.

14. The elastic band of claim 13, wherein the loops are circular.

15. The elastic band of claim 13, wherein an outer diameter D3 of the loops is about 6±2 inches, while the maximum lateral width $W_2$ is about 4±1 inches.

16. The elastic band of claim 13, wherein the maximum lateral width $W_2$ is about 4 inches, and the minor width $W_3$ is about 3 inches.

17. The elastic band of claim 13, wherein the thickness is about 3/16 inches.

18. The elastic band of claim 17, wherein the elastic band is made of EPDM.

19. The elastic band of claim 13, further including indicia printed on one or both sides of the central span which has characters or images that are compressed longitudinally when the band is relaxed, but which stretch and separate when the band is longitudinally stretched.

20. The elastic band of claim 19, wherein the indicia comprises numeric and/or alphabetic characters that assume normal font proportions when stretched.

* * * * *